US006293591B1

(12) United States Patent
Pecci

(10) Patent No.: US 6,293,591 B1
(45) Date of Patent: Sep. 25, 2001

(54) FOLDER ALLOWING CONVERSION INTO AN ADJUSTABLE BOOK-REST

(76) Inventor: Fabrizio Pecci, Via Montalbano, 11, 47048 S. Giovanni in Marignano (IT)

( * ) Notice: Subject to any disclaimer, the term of this patent is extended or adjusted under 35 U.S.C. 154(b) by 0 days.

(21) Appl. No.: 09/586,893

(22) Filed: Jun. 5, 2000

Related U.S. Application Data

(63) Continuation of application No. PCT/EP98/07719, filed on Nov. 30, 1998.

(30) Foreign Application Priority Data

Dec. 10, 1997 (IT) ..... F097A0027

(51) Int. Cl.[7] ..... A47B 23/00

(52) U.S. Cl. ..... 281/33; 281/29; 281/51; 402/4

(58) Field of Search ..... 281/33, 28, 36, 281/37, 29, 45, 51; 402/70, 73, 4

(56) References Cited

U.S. PATENT DOCUMENTS

| | | | | |
|---|---|---|---|---|
| 1,564,594 | * | 12/1925 | Leh | 281/33 |
| 2,550,279 | * | 4/1951 | Mamer | 281/33 X |
| 2,881,008 | * | 4/1959 | Goldman | 281/33 |
| 3,311,202 | | 3/1967 | Schell | 190/16 |
| 6,010,158 | * | 1/2000 | Croteau | 281/33 |

FOREIGN PATENT DOCUMENTS

| | | |
|---|---|---|
| C-458 058 | 3/1928 | (DE) . |
| A-21 28 366 | 12/1972 | (DE) . |
| A-2 689 734 | 10/1993 | (FR) . |

* cited by examiner

*Primary Examiner*—Willmon Fridie, Jr.
(74) *Attorney, Agent, or Firm*—Guido Modiano; Albert Josif; Daniel O'Byrne

(57) ABSTRACT

A folder which can be converted into an adjustable book-rest, characterized in that it is constituted by an articulated assembly which comprises a prism-like box which has an overturning cover (B,E,H,M) and a prop (C,F,I,O) which is connected between said cover and the bottom (A,D,G,L) of the box, at least one of said cover and of said bottom being provided with raised portions, to give a desired inclination to said cover with respect to the bottom, said cover supporting a document and retaining it at an edge thereof with a support.

42 Claims, 8 Drawing Sheets

FOLDER ALLOWING CONVERSION INTO AN ADJUSTABLE BOOK-REST

CROSS-REFERENCE TO RELATED APPLICATIONS

This application is a continuation of application number PCT/EP98/07719 filed on Nov. 30, 1998.

BACKGROUND OF THE INVENTION

The present invention relates to a folder allowing conversion into an adjustable book-rest.

One of the most widespread deformities acquired by the spinal column is idiopathic primary essential scoliosis. This is a permanent lateral deviation of the spine and is better known as adolescents' scoliosis since it is caused, especially in the school age, by incorrect scoliotic postures associated with general hypotonia of the muscles and ligaments. In practice, it is a deformation caused by alterations in the load due to an imbalance between static demands and the resistance of the spine in delicate, long-limbed, asthenic individuals.

However, since there is a lack of adequate preventive information, all this is almost always ignored until the disorder occurs, and the bad habit of reading in strange positions is widespread especially among younger people. Such positions are almost always assumed in order to improve visual perception but are unadvisable for anyone and especially for individuals who are already predisposed to deformation of the spinal column.

The present invention cannot of course correct congenital or already-acquired deformations, since altogether different solutions are required for these problems, but it can avoid the onset of alterations which are mainly due to prolonged scoliotic postures such as those assumed by children while reading books or newspapers which are perhaps large and are rested on the horizontal surface of a table or of a desk for adults.

U.S. Pat. No. 3,311,202 discloses a folder as defined in the preamble of claim

SUMMARY OF THE INVENTION

The aim of the present invention is to overcome the above-mentioned drawbacks.

In order to obviate the above-cited problems, the present invention proposes to use an original folder which is made of plastics or other suitable material and whose dimensions are chosen so as to allow to store therein a copybook and a few pens. It can, if necessary, assume a book-rest configuration in order to tilt a document enough to allow its optimum viewing and reading while assuming spontaneously, i.e., in a natural manner and without impositions, a posture in which one stands up straight or in any case without imbalances for the spinal column.

On a general level, it is an articulated assembly which comprises a prism-like box with an overturning cover and a prop which is pivoted to one of the two parts of the box (cover or bottom) and can be coupled to the other, which is provided with notches or other suitable means, according to the configuration to be given to the cover with respect to the bottom when, by using the invention as a desktop book-rest, it supports the document in an inclined position and retains it at the base with a fixed or retractable support.

The above aim and other objects which will become apparent hereinafter are achieved by a folder as claimed in the appended claims.

BRIEF DESCRIPTION OF THE DRAWINGS

Four of the possible embodiments of the present invention are illustrated, merely by way of non-limitative examples, in the accompanying drawings, in which.

DESCRIPTION OF THE PREFERRED EMBODIMENTS

With reference to the accompanying drawings, and starting from the figures related to the first embodiment, shown in FIGS. 1–8, the combined folder and book-rest, which can be made of plastics and as a single folding part, has three rigid portions (A-B-C) which are articulated in connecting regions 1 and 2, which are termed folds by convention and can be obtained by means of scoring or by two-component molding, i.e., by means of the injection of two thermoplastic materials having a different degree of rigidity.

Figure 5:
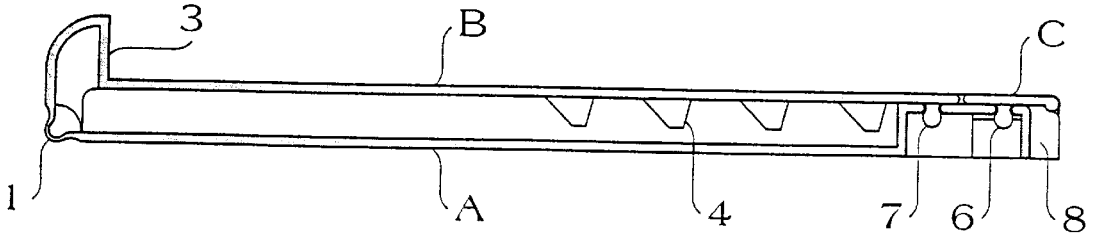
Figure 6:
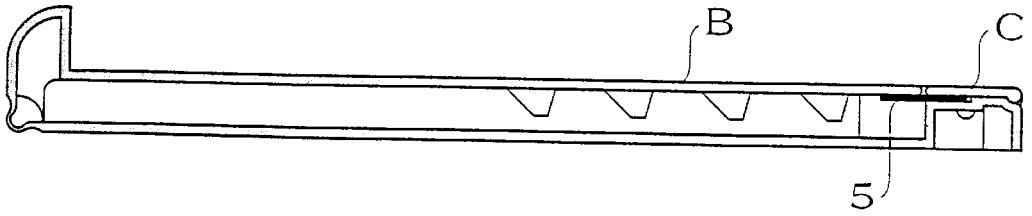
Figure 7:
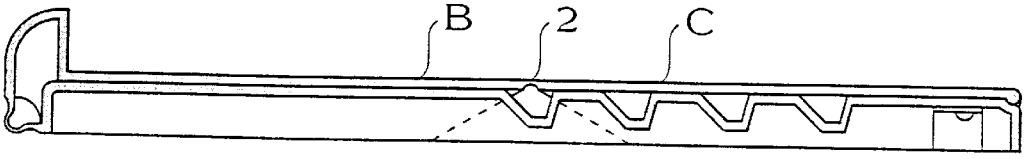
Figure 8:
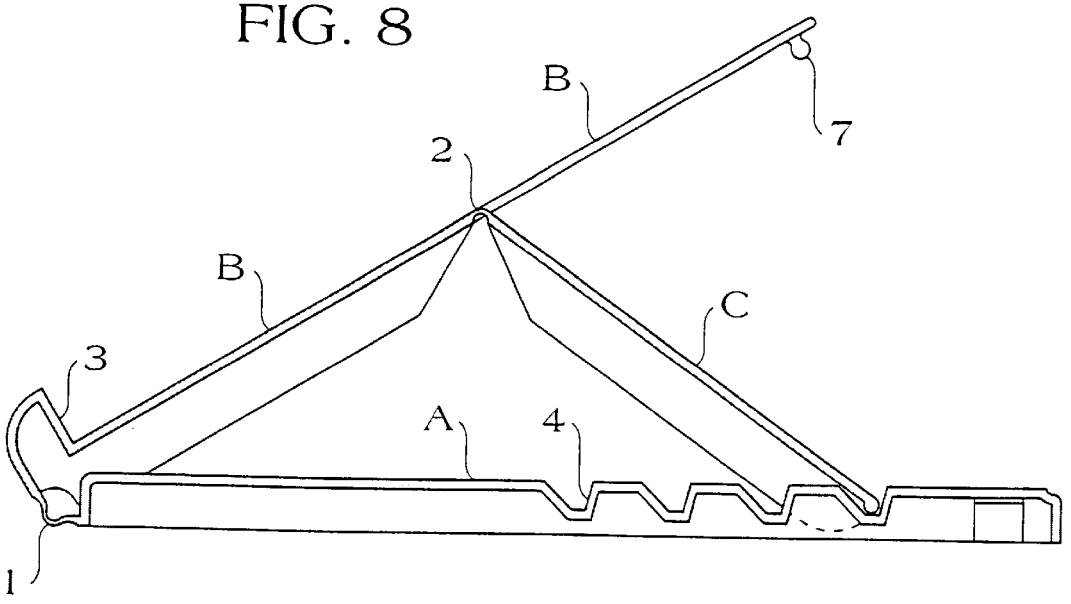
Figure 10:
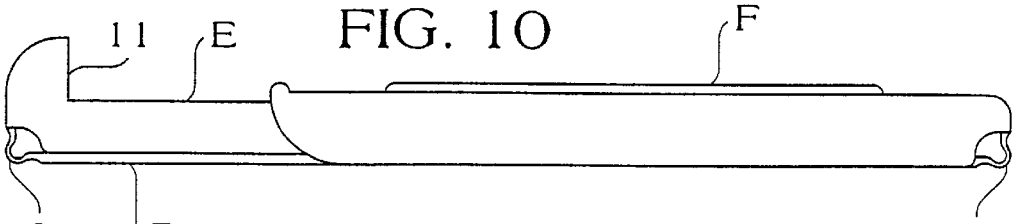
FIGS. 9 to 13 are views of another embodiment which can be produced by monolithic molding, respectively a top view, a side view, a sectional view taken along the plane X—X in the folder configuration, and a sectional view, taken along the plane Y—Y, in the folder configuration and in the book-rest configuration.
Figure 9:
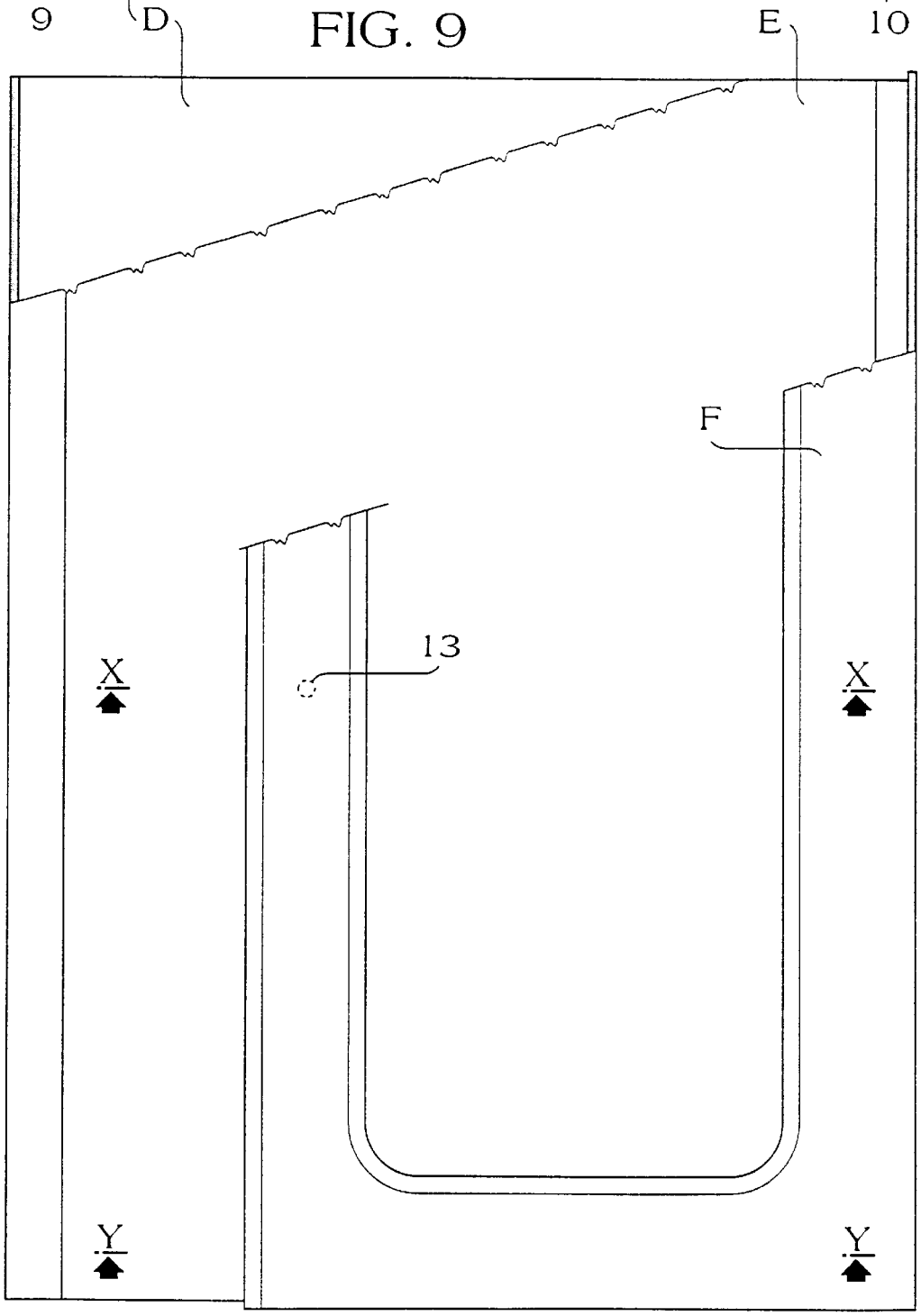
Figure 11:
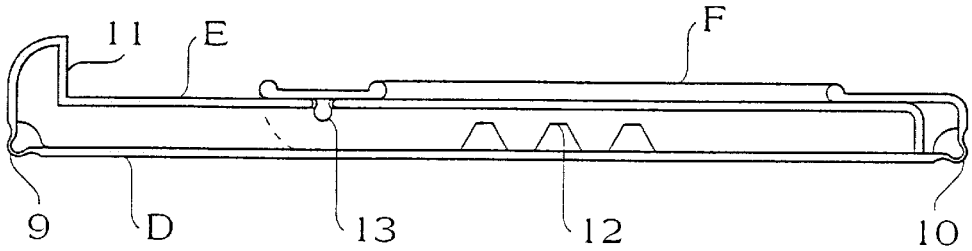
Figure 12:
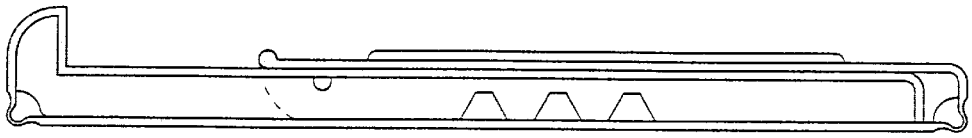
Figure 13:
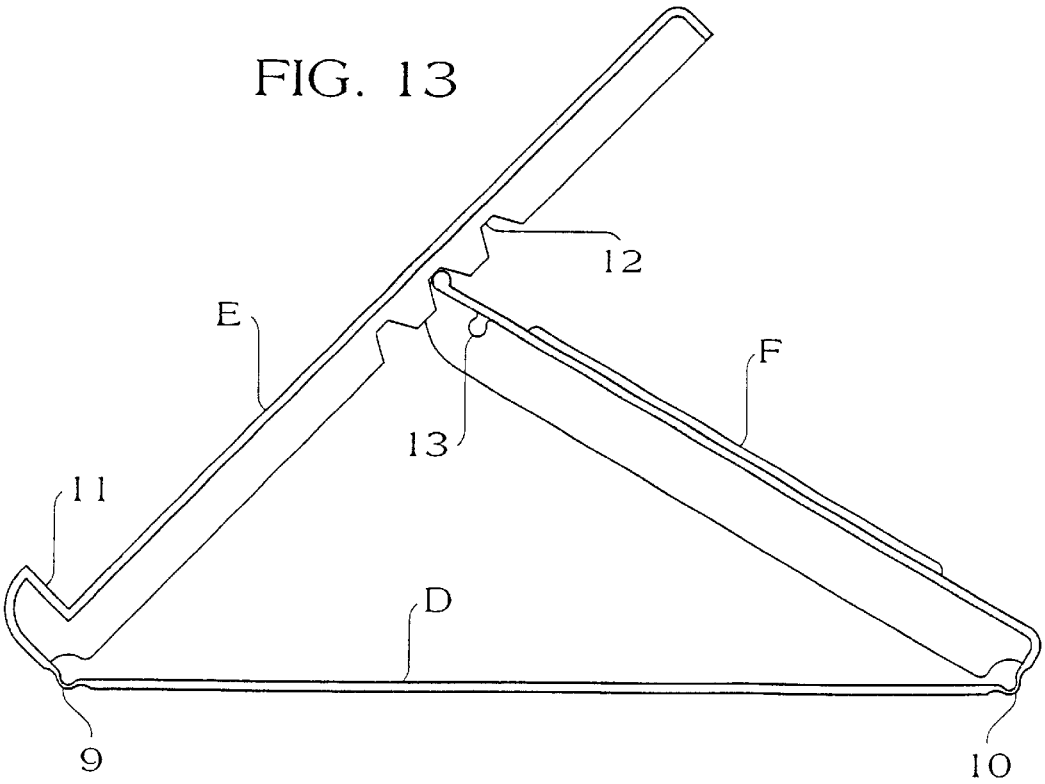
Figure 15:
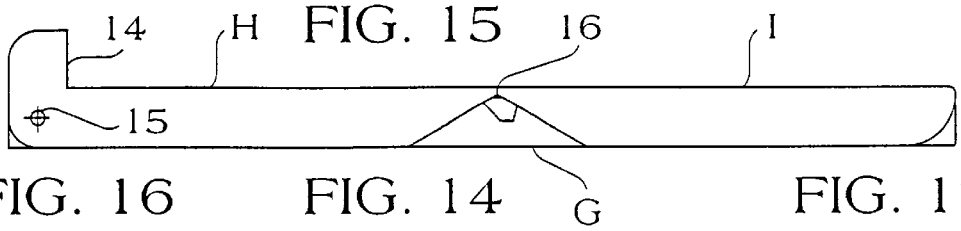
FIGS. 14 to 21 are views of an embodiment obtained by means of the articulated connection of three parts, respectively a top view, a side view, a front view, a rear view, sectional views taken along the planes X—X and Y—Y in the folder configuration, and a sectional view, taken along the plane Z—Z, in the folder configuration and in the book-rest configuration.

The portion A, i.e., the bottom of the box, is delimited at one side by the fold 1 and at the other three sides by a raised portion on which the: cover B and the portion C rest so as to be co-planar when closed (FIG. 5). The portion C is meant to act as a prop, because it is joined to the cover in the two folds 2 which are mutually aligned and parallel to the fold 1 and allow it to rotate downward and to engage in notches 4 of the bottom in order to support the cover B when, lifted in the book-rest configuration as in FIG. 8, it provides an inclined support for a document, which is retained at the base by means of a raised portion 3 of the cover B.

Figure 2:
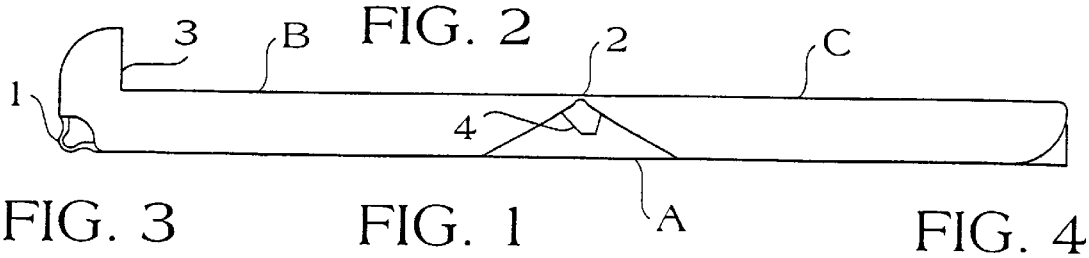
FIGS. 1 to 8 are views of an embodiment which can be produced by monolithic molding, respectively a top view, a side view, a front view, a rear view, sectional views taken along the planes X—X and Y—Y in the folder configuration and a sectional view, taken along the plane Z—Z, in the folder and book-rest configurations.
Figure 3:
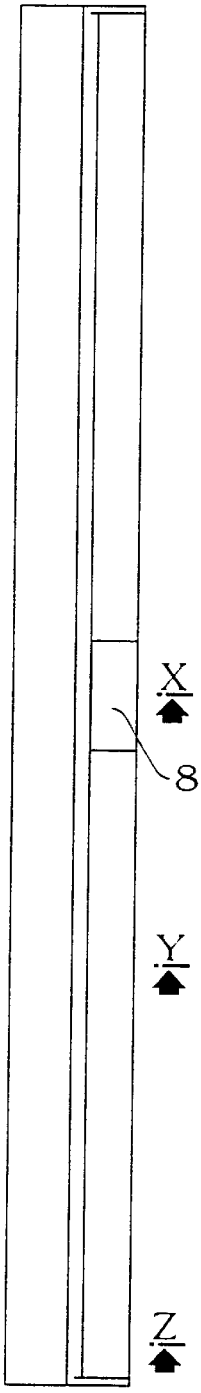
Figure 1:
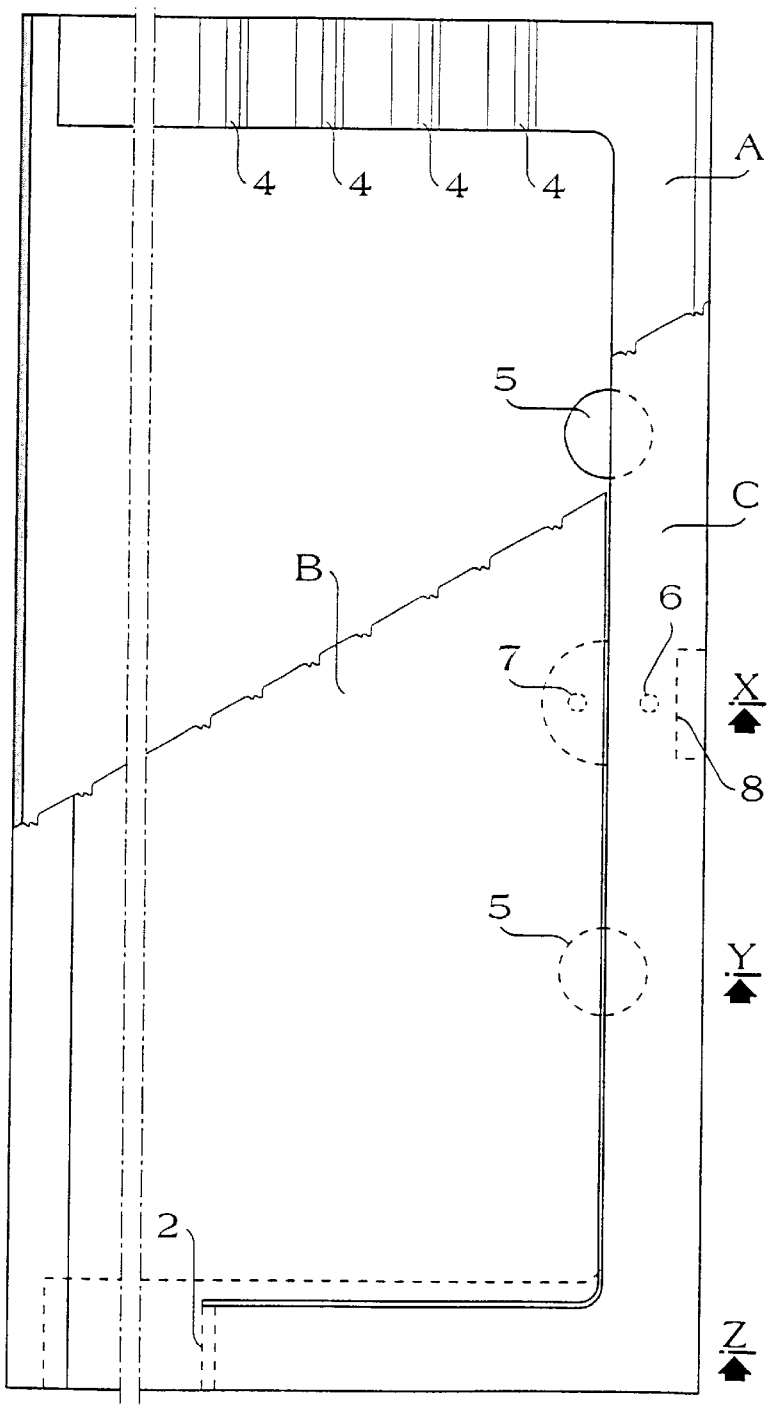
Figure 4:
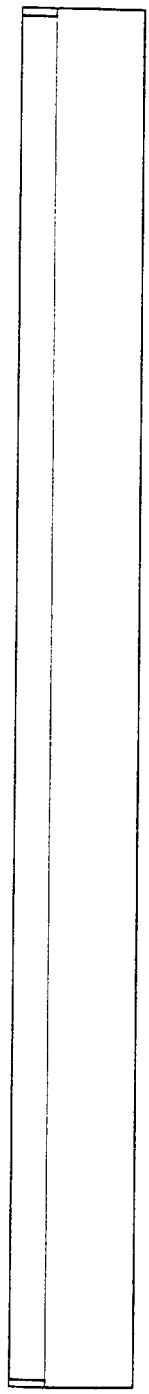

In the bottom A, particularly in the raised portion that is parallel to the fold 1, there are provided female parts for a press-fit engagement of male elements 6 and 7 that protrude from a lower face of the cover B and of the prop C in order to fix them to the bottom when the assembly is in the folder configuration shown in FIGS. 1 and 5.

These are two press-studs which can be disengaged by lifting with one finger the prop C from an appropriately provided front recess 8 of the bottom A. Especially in order to prevent the yielding of the material in the folds 2, on a lower face of the prop C there are plates 5 which, by protruding below the cover B, cause the prop and the cover, when the prop is lifted, to rotate about the fold 1, while the plates 5 instead have no effect on the cover B when the prop C rotates downward about the folds 2.

The combined folder and book-rest of FIGS. 9–13 also can be made of plastics and of a single folding part and has three rigid portions (D-E-F) which are articulated in folds 9 and 10 by virtue of suitable scoring or two-component molding.

The folds 9 and 10 form the two parallel sides of the bottom D, to which the cover E is connected at one side and the prop F is connected at the other side. In the book-rest configuration (FIG. 11), the prop F is superimposed on the cover E and inserts, with a push-fit coupling, its male part 13 in a suitably provided female part. Otherwise, in the book-rest configuration, the prop F lies below the cover B and its very edge is engaged in notches 12 of lateral shoulders that protrude from a lower part of the cover, which is also provided with a raised portion 11 protruding from an upper part of the cover in order to retain a document on the book-rest.

The combined folder and book-rest of FIGS. 14–21 is constituted by three parts (G-H-I) which can be made of plastics or other suitable material and are hinged at hinges 15 and 16. While the hinge 15 is constituted by raised portions, pivots, rivets or other equivalent means which allow the rotary connection of the sides of the cover H to the sides of the bottom G, the hinge 16 is formed by gluing or otherwise fixing a small strip of soft or flexible material so that it straddles the cover G and the prop I in the lower face of both, i.e., inside the only fold allowed to said parts.

Figures 14, 16, 17:
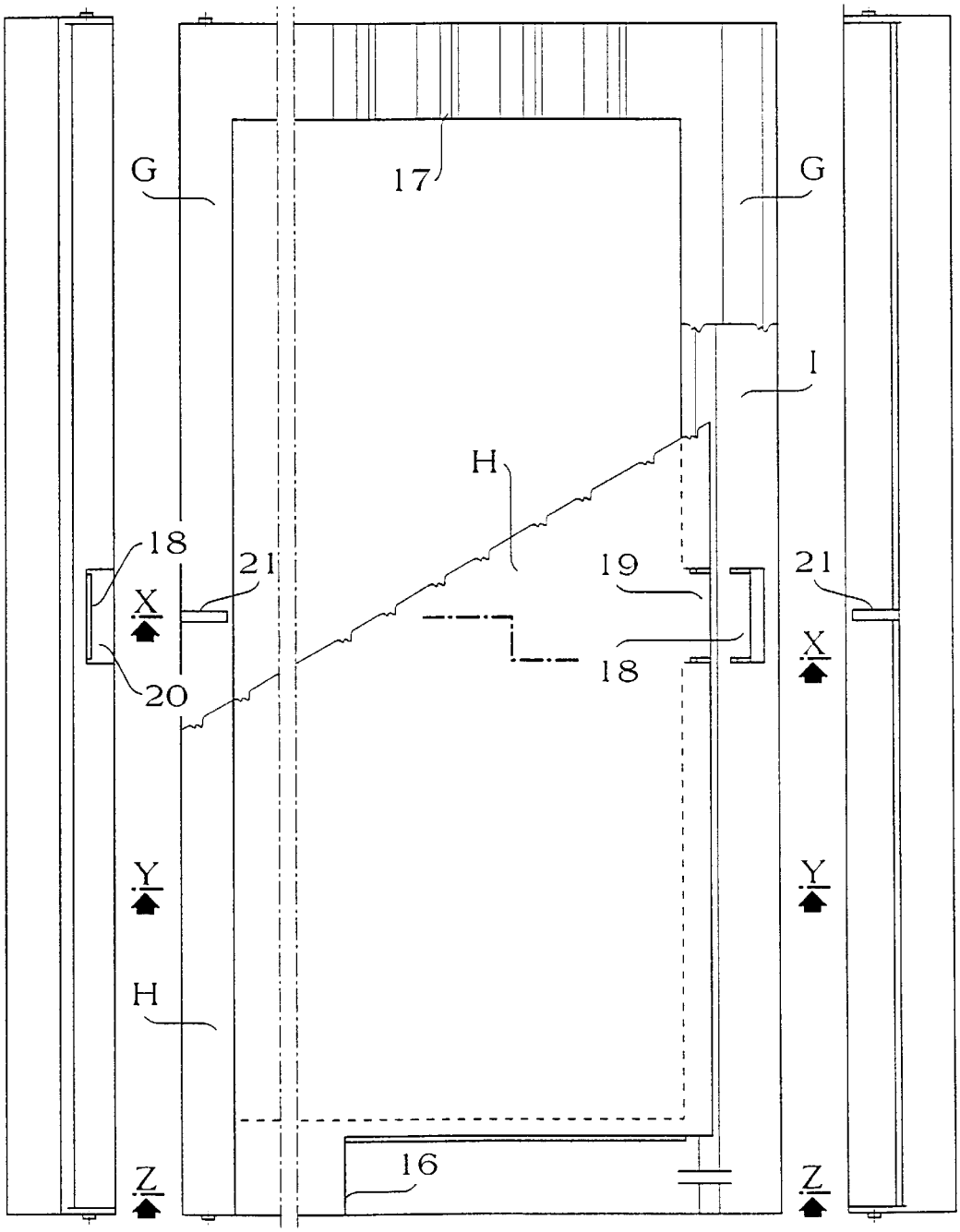
Figure 18:
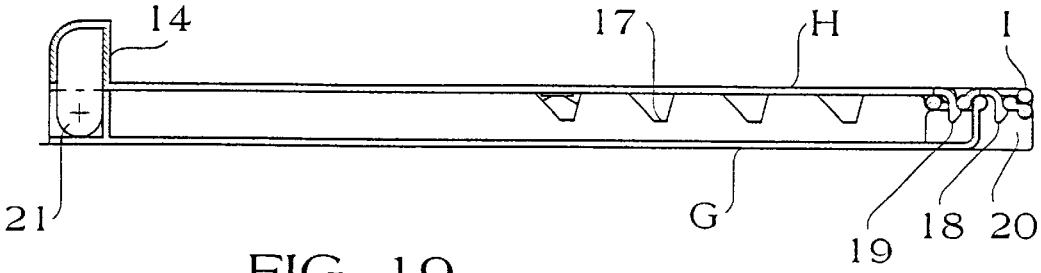
Figure 19:
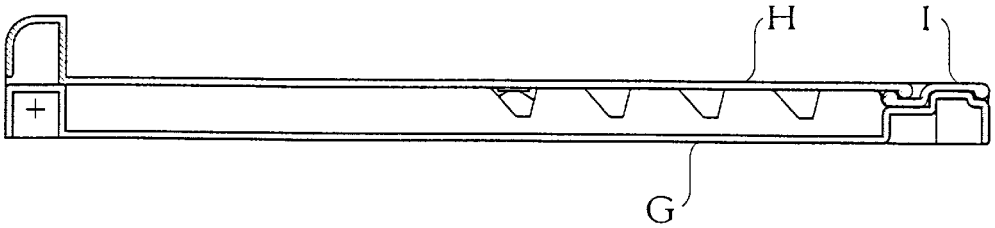
Figure 20:
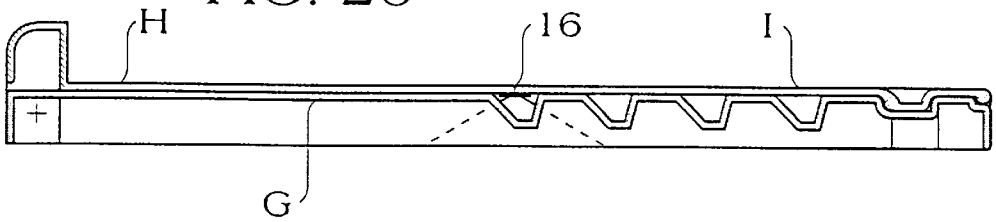

The cover H and the prop I, both of which rest when closed on the perimetric raised portion of the bottom G, are in fact shaped so that the former surmounts the latter and indeed engages its snap-acting tooth 19 therein (FIGS. 14 and 18). Another snap-acting tooth 18, provided in the prop I, engages the bottom G at the front recess 20, which can be accessed with a finger for release, which allows to lift the assembly constituted by the prop and the cover, which rotates about 15.

Figure 21:
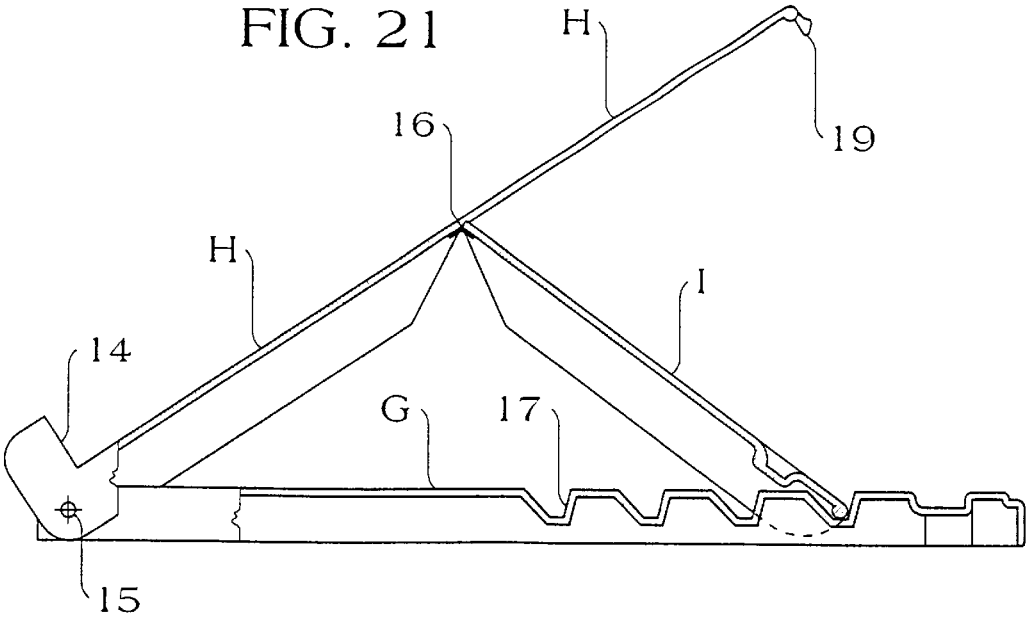
Figure 23:
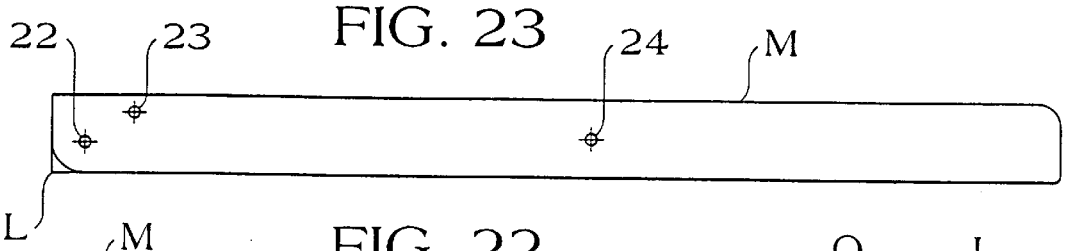
FIGS. 22 to 27 are views of an embodiment obtained by means of the articulated connection of four parts, respectively a top view, a side view, sectional views taken along the planes X—X and Y—Y in the folder configuration, and a sectional view taken along the plane Z—Z in the folder configuration and in the book-rest configuration.
Figure 22:
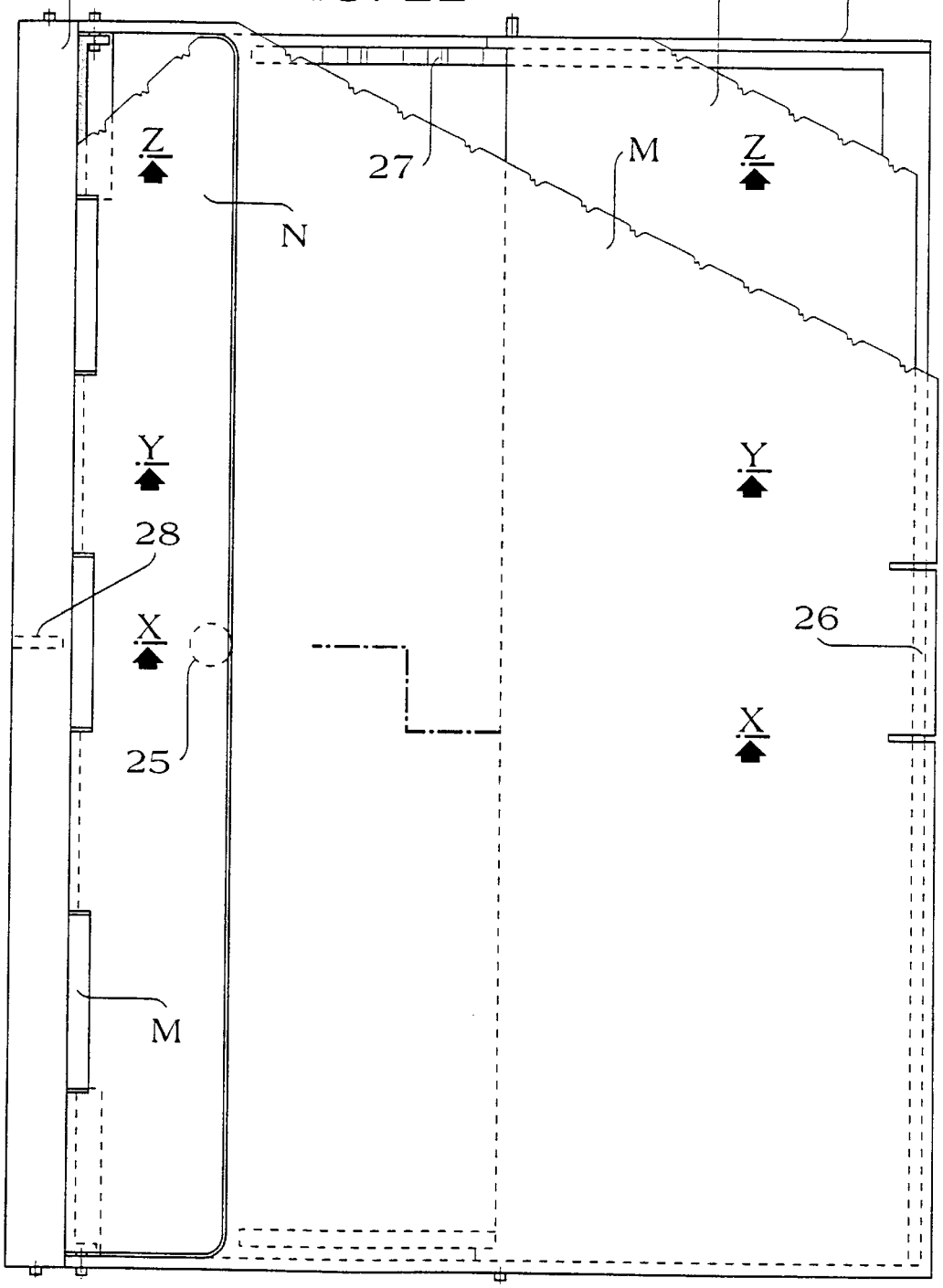

In order to obtain the book-rest configuration of FIG. 21, the prop I, which is first released from the bottom G and then from the snap-acting tooth 19 of the cover H, is rotated about the hinge 16 until its front edge engages the notches 17 formed in the perimetric raised portion of the bottom G.

In this embodiment too, the cover H has a fixed raised portion 14 whereby the document that it supports in an inclined position can be retained at the base.

At the raised portion 14, on the lower side of the cover H, there is a tab 21 (FIGS. 17 and 18) which descends centrally and enters a corresponding notch (also designated by the reference numeral 21 in FIG. 14) which is provided in the perimetric raised portion of the bottom G.

By ensuring the constant centering of the cover H on the bottom G, this refinement prevents axial stresses on the hinge 15, which can therefore be provided by means of simple cylindrical raised portions protruding from the sides of the cover or bottom and inserted by snap action in corresponding seats formed in the sides of the other part.

The combined folder and book-rest of FIGS. 22–27 is constituted by four parts (L-M-N-O), which can be made of plastics or other suitable material and are connected by hinges 22, 23 and 24, all of which are related to the cover M. The bottom L, the bracket N and the prop 0 are rotatably connected to the sides of the cover M at 22, 23, and 24 respectively.

As already described for the preceding embodiment, a tab 28 (FIGS. 22 and 24) descends centrally from a rear region of the cover M and, by entering the corresponding notch formed in a raised hinge portion of the bottom L, prevents axial stresses on the hinge 22. Such hinge can accordingly be provided by means of two simple cylindrical raised portions protruding on the two sides of the bottom L and meant to be engaged with a snap action in the appropriately provided holes formed in the sides of the cover M together with the holes for the similar hinging of the bracket N at hinge 23 and of the prop O at hinge 24, both of which have the necessary cylindrical raised portions.

However, all or some of the three hinges might also be provided by means of applied pivots, rivets or other means.

Figure 27:
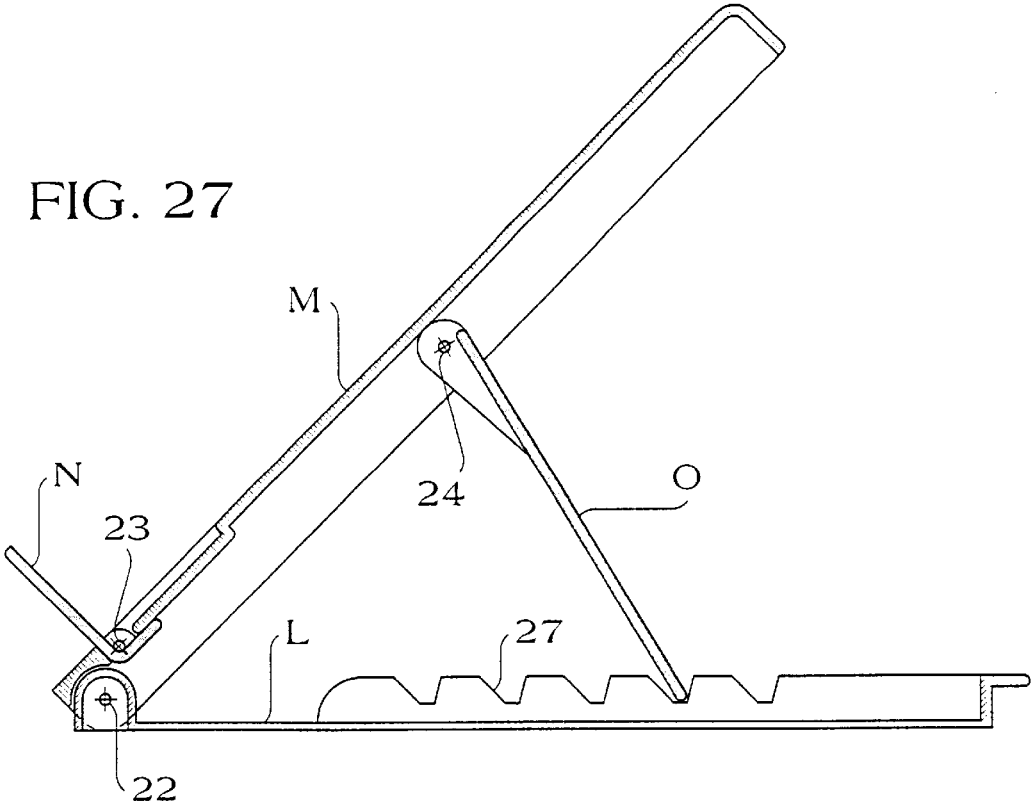
Figure 26:
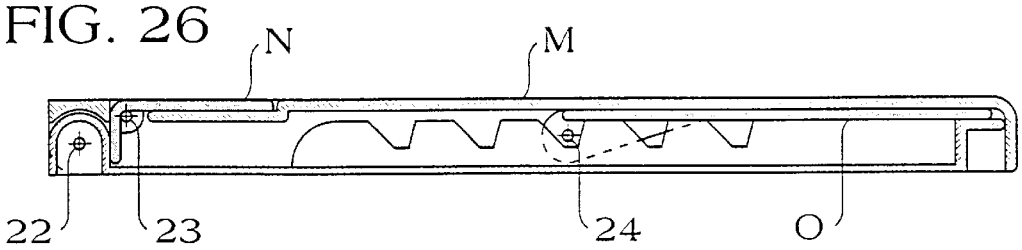
Figure 25:
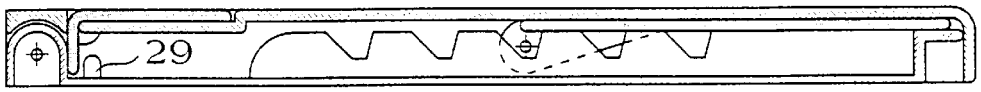
Figure 24:
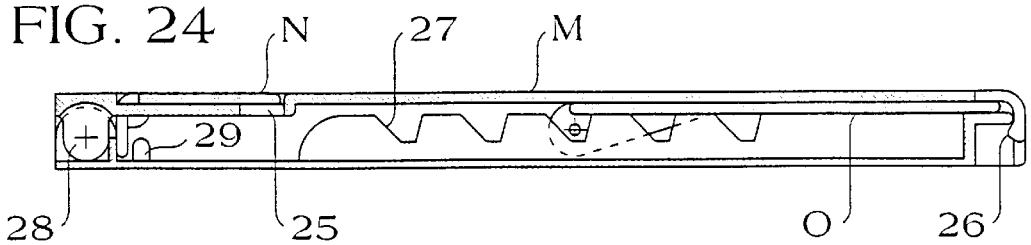

Regardless of its hinging method, the bracket N is meant to rotate through 90° about hinge 23 in order to move from the recessed seat of the cover M to the configuration for its use, shown in FIG. 27, where it is supported, at suitable openings of the cover, by tabs with which it is provided and which are arranged at right angles and rest against the lower surface of said cover.

The tabs, when the assembly is in the collapsed condition, lie at right angles proximate to the bottom L, from which one or more stop teeth 29) protrude which prevent the tabs from rotating about hinge 23 but not from following the cover as it rotates about hinge 22.

The hole 25, which is provided in the recessed seat of the cover M that accommodates the bracket N, allows to extract the bracket by acting with one finger from the rear of the raised cover.

The prop O, which supports the cover M in the book-rest configuration by engaging its end in the notches 27 of two lateral ribs of the bottom L, in the folder configuration rests flat on the ribs and on the raised portion that connects them, along the front side of the bottom L, so as to be able to engage therewith the snap-acting tooth 26 of the cover M which rests on the prop O.

It should be noted that in this embodiment as in the preceding one, the sides of the cover M, which are conveniently rounded in the rear end, discharge the weight of the book directly onto the table that supports the book-rest and accordingly do not bear onto the means for hinging the cover M to the bottom 2.

It is evident that without altering the general characteristics that have been illustrated and described, the practical embodiment of the invention might entail additional modifications or variations chosen as a function of the materials used or of the production methods. Accordingly, although solutions which are particularly unexpensive because they can be mass-manufactured industrially have been shown by way of non-limitative examples, the scope of the present invention also includes any industrial or handicraft embodiments based on the use of fabrics or hides which, reinforced by rigid or flexible inserts where necessary, would directly provide the articulations required to open and close the folder and to orientate and fold the prop.

The disclosures in Italian Patent Application No. FO97A000027 from which this application claims priority are incorporated herein by reference.

What is claimed is:

1. A folder which can be converted into an adjustable book-rest, comprising an articulated assembly which comprises a box having an overturning cover, a prop being connected between said cover and the inner side of the bottom of the box, wherein at least one of the cover and of the bottom of the cover is provided with raised portions, to give a desired inclination to said cover, said cover of the box being adapted to support a document and retain it at an edge thereof with a support, said cover being adapted to pass from a first position in which the cover is flat and arranged to directly close the box, to a second position in which the cover is angled with respect to the bottom of said box, said cover supporting on its outer side the document in both said first and second positions, and wherein the bottom is delimited at one side by a first fold and at the other three sides by a raised portion on which the cover and the prop rest in a co-planar arrangement when closed, said prop being joined to the cover in two further folds which are mutually aligned and parallel to the first fold and allow it to rotate downward and engage in notches of the bottom in order to support the cover when it is raised in the book-rest configuration and provides an inclined support to the text, which is retained by means of said support.

2. The folder according to claim 1, wherein in the bottom, there are provided female parts for a press-fit engagement of male elements that protrude respectively from a lower face of the cover and from the face of the prop that reaches the font edge of the bottom and can be raised by acting upon a recess thereof.

3. The folder according to claim 2, wherein said prop is provided, in the lower face thereof, with plates which, by protruding below the cover, cause said prop and said cover, when the prop is lifted, to rotate about the first fold, said plates having no effect on the cover when the prop rotates downward on the two further folds.

4. The folder according to claim 1, wherein fold lines art provided to form two parallel sides of the bottom to which the cover is connected on one side and the prop is connected on the other side, said prop surmounting the cover and a male part of said prop being inserted in a female seat of the cover with a push fit in the folder configuration, the edge of said prop, in the book-rest configuration, engaging the notches of lateral shoulders that protrude from the lower part of the cover, which is provided with said support protruding from the upper part in order to retain the document on the book-rest.

5. The folder according to claim 1, wherein the cover, which is hinged to the bottom and to the prop by means of first and second hinges, in the folder configuration rests on a perimetric raised portion of the bottom, overlapping and engaging, with a snap-acting tooth, the prop, which also rests on said raised portion, which it engages by means of a disengageable snap-acting tooth, in order to lift the prop together with the cover, by inserting a finger in a corresponding recess of the bottom.

6. The folder according to claim 5, wherein said prop is hinged to the cover by means of a strip which is applied so as to straddle the prop and the cover.

7. The folder according to claim 5, wherein a tab protrudes downward from a lower side of the cover and enters a corresponding notch of the bottom in order to prevent axial stresses of the hinges, which are provided by means of cylindrical raised portions protruding from the sides of the bottom or of the cover and inserted by snap action in corresponding seats formed in the sides of the opposite part.

8. The folder according to claim 5, wherein the bottom has a perimetric raised portion, in the notches of which the very edge of the prop is engaged in order to support in an inclined configuration the cover, said support of which retains the document rested thereon at its base.

9. The folder according to claim 1, wherein the bottom, a rotating or retractable bracket and the prop meant to support the cover at an angle are hinged to the side of the cover and against its inner face.

10. The folder according to claim 9, wherein a tab protrudes downward centrally from a rear region of the cover and enters a corresponding notch which is provided in a raised portion for the hinging of the bottom to prevent axial stresses from affecting a hinge, which is provided by means of two cylindrical raised portions protruding at two sides of the bottom and meant to be engaged, with a snap action, in holes formed in the sides of the cover together with holes for a pivoting of the bracket and the prop.

11. The folder according to claim 9, wherein said bracket is meant to rotate through 90° in order to pass from a recessed seat of the cover to an operating configuration, in which it is supported, at openings of the cover, by tabs with which it is provided, said tabs being arranged at right angles and resting against the lower surface of said cover; when the assembly is in a collapsed configuration, said tabs lying at right angles proximate to the bottom, from which at least one stop tooth protrudes, preventing said tabs from rotating about a hinge.

12. The folder according to claim 11, wherein in the recessed seat provided in the cover to accommodate the bracket a hole is provided which allows to extract the bracket by acting with one finger from the rear of the cover.

13. The folder according to claim 9, wherein the prop, meant to support the cover when its end is engaged in notches of two lateral ribs of the bottom, in the folder configurations rest flat on said ribs and on the raised portion that connects them, along the front side of the bottom, so to be able to engage thereon a snap-acting tooth of the cover, which rest on said prop.

14. The folder according to claim 1, wherein the sides of the cover, which are rounded at the rest end, discharge the weight of the document directly onto the table on which the book-rest stands, without bearing on the means for hinging the cover to the bottom.

15. A folder which can be converted into an adjustable book-rest, comprising an articulated assembly which comprises a box having an overturning cover, a prop being connected between said cover and the inner side of the bottom of the box, wherein at least one of the cover and of the bottom of the cover provided with raised portions, to give a desired inclination to said cover, said cover of the box being adapted to support a document and retain it at an edge thereof with a support, said cover being adapted to pass from a first position in which the cover is flat and arranged to directly close the box, to a second position in which the cover is angled with respect to the bottom of said box, said cover supporting on its outer side the document in both said first and second positions, and wherein the bottom, a rotating or retractable bracket and the prop meant to support the cover at an angle are hinged to the sides of the cover and against its inner face.

16. The folder according to claim 15, wherein the bottom is delimited at one side by a first fold and at the other three sides by raised portion on which the cover and the prop rest in a co-planar arrangement when closed, said prop being joined to the cover in two further folds which are mutually aligned and parallel to the first fold and allow it to rotate downward and engage in notches of the bottom on order to support the cover when it is raised in the book-rest configuration and provided an inclined support to the text, which is retained by means of said support.

17. The folder according to claim 16, wherein in the bottom, there are provided female parts for a press-fit engagement of male elements that protrude respectively from a lower face of the cover and from the face of the prop that reaches the front edge of the bottom and can be raised by acting upon a recess thereof.

18. The folder according to claim 17, wherein said prop is provided, in the lower face thereof, with plates which, by protruding below the cover, cause said prop and said cover, when the prop is lifted, to rotate about the first fold, said plates having no effect on the cover when the prop rotates downward on the two further folds.

19. The folder according to claim 15, wherein folds lines are provided to form two parallel sides of the bottom to which the cover is connected on one side and the prop is connected on the other side, said prop surmounting the cover and a male part of said prop being inserted in a female seat of the cover with a push fit in the folder configuration, the edge of said prop, in the book-rest configuration, engaging the notches of lateral shoulders that protrude from the lower part of the cover, which is provided with said support protruding from the upper part in order to retain the document on the book-rest.

20. The folder according to claim 15, wherein the cover, which is hinged to the bottom and to the prop by means of first and second hinges, in the folder configuration rests on a perimetric raised portion of the bottom, overlapping and engaging, with a snap-acting tooth, the prop, which also rest on said raised portion, which it engages by means of a disengageable snap-acting tooth, in order to lift the prop together with the cover, by inserting a finger in a corresponding recess of the bottom.

21. The folder according to claim 20, wherein said prop is hinged to the cover by means of strip which is applied so as to straddle the prop and the cover.

22. The folder according to claim 7, wherein a tab protrudes downward from a lower side of the cover and enters a corresponding notch of the bottom in order to prevent axial stresses of the hinges, which are provided by means of cylindrical raised portions protruding from the sides of the bottom or of the cover and inserted by snap action in corresponding seats formed in the sides of the opposite part.

23. The folder according to claim 20, wherein the bottom has a perimetric raised portion, in the notches of which the very edge of the prop is engaged on order to support in an inclined configuration the cover, said support of which retains the document rested thereon at its base.

24. The folder according to claim 15, wherein a tab protrudes downward centrally from a rear region of the cover and enters a corresponding notch which is provided in raised portion for the hinging of the bottom to prevent axial stresses from affecting a hinge, which is provided by means of two cylindrical raised portions protruding at two sides of the bottom and meant to be engaged, with a snap action, in holes formed in the sides of the cover together with holes for a pivoting of the bracket and of the prop.

25. The folder according to claim 15, wherein said bracket is meant to rotate through 90° in order to pass from a recessed seat of the cover to an operating configuration, in which it is supported, at openings of the cover, by tabs with which it is provided, said tabs being arranged at right angles and resting against the lower surface of said cover; when the assembly is in a collapsed configuration, said tabs lying at right angles proximate to the bottom, from which at least one stop tooth protrudes, preventing said tabs from rotating about a hinge.

26. The folder according to claim 25, wherein in the recessed seat provided in the cover to accommodate the bracket a hole is provided which allows to extract the bracket by acting with one finger from the rear of the cover.

27. The folder according to claim 15, wherein the prop, meant to support the cover when its ends is engaged in notches of two lateral ribs of the bottom, in the folder configuration rests flat on said ribs and on the raised portion that connects them, along the front side of the bottom, so as to be able to engage thereon a snap-acting tooth of the cover, which rests on said prop.

28. The folder according to claim 15, wherein the sides of the cover, which are rounded at the rear end, discharge the weight of the document directly onto the table on which the book-rest stands, without bearing on the means for hinging the cover to the bottom.

29. A folder which can be converted into an adjustable book-rest, comprising an articulated assembly which comprises a box having an overturning cover, a prop being connected between said cover and the inner side of the bottom of the box, wherein at least one of the cover and of the bottom of the cover is provided with raised portions, to give a desired inclination to said cover, said cover of the box being adapted to support a document and retain it at an edge thereof with a support, said cover being adapted to pass from a first position in which the cover is flat and arranged to directly close the box, to a second position on which the cover is angled with respect to the bottom of said box, said cover supporting on its outer side the document in both said first and second positions, wherein the cover, which is hinged to the bottom and to the prop by means of first and second hinges, in the folder configuration rests on a perimetric raised portion of the bottom, overlapping and engaging, with a snap-acting tooth, the prop, which also rests on said raised portion, which it engages by means of a disengageable snap-acting tooth, in order to lift the prop together with the cover, by inserting a finger in a corresponding recess of the bottom.

30. The folder according to claim 29, wherein the bottom is delimited at one side by a first fold and at the other three sides by raised portion on which the cover and the prop rest in a co-planar arrangement when closed, said prop being joined to the cover in two further folds which are mutually aligned and parallel to the first fold and allow it to rotate downward and engage in notches of the bottom in order to support the cover when it is raised in the book-rest configuration and provided an inclined support to the text, which is retained by means of said support.

31. The folder according to claim 30, wherein in the bottom, there are provided female parts for a press-fit engagement of male elements that protrude respectively from a lower face of the cover and from the face of the prop that reaches the front edge of the bottom and can be raised by acting upon a recess thereof.

32. The folder according to claim 31, wherein said prop is provided, in the lower face thereof, with plates which, by protruding below the cover, cause said prop and said cover, when the prop is lifted, to rotate about the first fold, said plates having no effect on the cover when the prop rotates downward on the two further folds.

33. The folder according to claim 29, wherein fold lines are provided to form two parallel sides of the bottom to which the cover is connected on one side and the prop is connected on the side, said prop surmounting the cover and male part of said prop being inserted in a female seat of the cover with a push fit in the folder configuration, the edge of said prop, in the book-rest configuration, engaging the notches of lateral shoulders that protrude from the lower part of the cover, which is provided with said support protruding from the upper part in order to retain the document on the book-rest.

34. The folder according to claim 29, wherein said prop is hinged to the cover by means of a strip which is applied so as to straddle the prop and the cover.

35. The folder according to claim 29, tab protrudes downward from a lower side of the cover and enters a corresponding notch of the bottom in order to prevent axial stresses of the hinges, which are provided by means of cylindrical raised portions protruding from the sides of the bottom or of the cover and inserted by snap action in corresponding seats formed in the sides of the opposite part.

36. The according to claim 29, wherein the bottom has a perimetric raised portion, in the notches of which the very edge of the prop is engaged in order to support in an inclined configuration the cover, said support of which retains the document rested thereon at its base.

37. The folder according to claim 29, wherein the bottom, a rotating or retractable bracket and the prop meant to support the cover at an angle are hinged to the sides of the cover and against its inner face.

38. The folder according to claim 37, wherein a tab protrudes downward centrally from a rear region of the cover and enters a corresponding notch which is provided in a raised portion for the hinging of the bottom to prevent axial stresses from affecting a hinge, which is provided by means to engaged, with a snap action, in holes formed in the sides of the cover together with holes for a pivoting of the bracket and of the prop.

39. The folder according 37, wherein said bracket is meant to rotate through 90° in order to pass from a recessed seat of the cover to an operating configuration, in which it is supported, at openings of the cover, by tabs with which it is provided, said tabs being arranged at right angles and resting against the lower surface of said cover; when the assembly is in a collapsed configuration, said tabs lying at right angles proximate to the bottom, from which at least one stop tooth protrudes, preventing said tabs from rotating about a hinge.

40. The folder according to claim 39, wherein in the recessed seat provided in the cover to accommodate the bracket a hole is provided which allows to extract the bracket by acting with one finger from the rear of the cover.

41. The folder according to claim 37, wherein the prop, meant to support the cover when its end is engaged in notches of two lateral ribs of the bottom, in the folder configurations rest flat on said ribs and on the raised portion that connects them, along the front side of the bottom, so to be able to engage thereon a snap-acting tooth of the cover, which rest on said prop.

42. The folder according to claim 29, wherein the sides of the cover, which are rounded at the rear end, discharge the weight of the document directly onto the table on which the book-rest stands, without bearing on the means for hinging the cover to the bottom.

* * * * *